US005107432A

United States Patent [19]

Martinelli

[11] Patent Number: 5,107,432

[45] Date of Patent: Apr. 21, 1992

[54] SYSTEM FOR PROTECTION OF AUTOMOTIVE EXHAUST GAS COMBUSTION DEVICES

[75] Inventor: Paolo Martinelli, Modena, Italy

[73] Assignee: Ferrari S.p.A., Modena, Italy

[21] Appl. No.: 538,980

[22] Filed: Jun. 15, 1990

[30] Foreign Application Priority Data

Jun. 16, 1989 [IT] Italy ..... 67493 A/89

[51] Int. Cl.[5] ..... F01N 3/00; F01N 7/00

[52] U.S. Cl. ..... 364/431.09; 60/277; 123/440; 123/479; 123/489; 364/431.05

[58] Field of Search ..... 364/431.05, 431.06, 364/431.09; 123/440, 479, 480, 489; 60/276, 277

[56] References Cited

U.S. PATENT DOCUMENTS

| | | | |
|---|---|---|---|
| 3,955,363 | 5/1976 | Manderscheid | 60/277 |
| 4,015,428 | 4/1977 | Kawai | 60/277 |
| 4,024,850 | 5/1977 | Peter et al. | 60/277 X |
| 4,233,811 | 11/1980 | Masaki | 60/274 |
| 4,319,451 | 3/1982 | Tajima et al. | 60/277 x |
| 4,348,728 | 9/1982 | Sagisaka et al. | 364/431.05 X |
| 4,379,387 | 4/1983 | Iizuka et al. | 60/277 |
| 4,450,814 | 5/1984 | Sawamoto et al. | 123/478 |
| 4,484,548 | 11/1984 | Sugasawa et al. | 60/277 X |
| 4,729,220 | 3/1988 | Terasaka et al. | 60/277 X |

*Primary Examiner*—Parshotam S. Lall
*Assistant Examiner*—E. J. Pipala
*Attorney, Agent, or Firm*—Michael N. Meller

[57] ABSTRACT

A system for protecting the catalytic exhaust gas combustion devices of an automotive engine featuring two sets of cylinders, which system has, for each set of cylinders: a first sensor housed in the exhaust pipe downstream from the catalytic combustion device and designed to supply a first signal as a function of the temperature of the combustion device; a comparing block for supplying a second signal in response to the first signal reaching a threshold value indicating a predetermined temperature of the combustion device; and a central processing unit of an electronic fuel injection system, designed to cut off a fuel supply to the injectors of the aforementioned set of cylinders as a function of the aforementioned second signal.

9 Claims, 2 Drawing Sheets

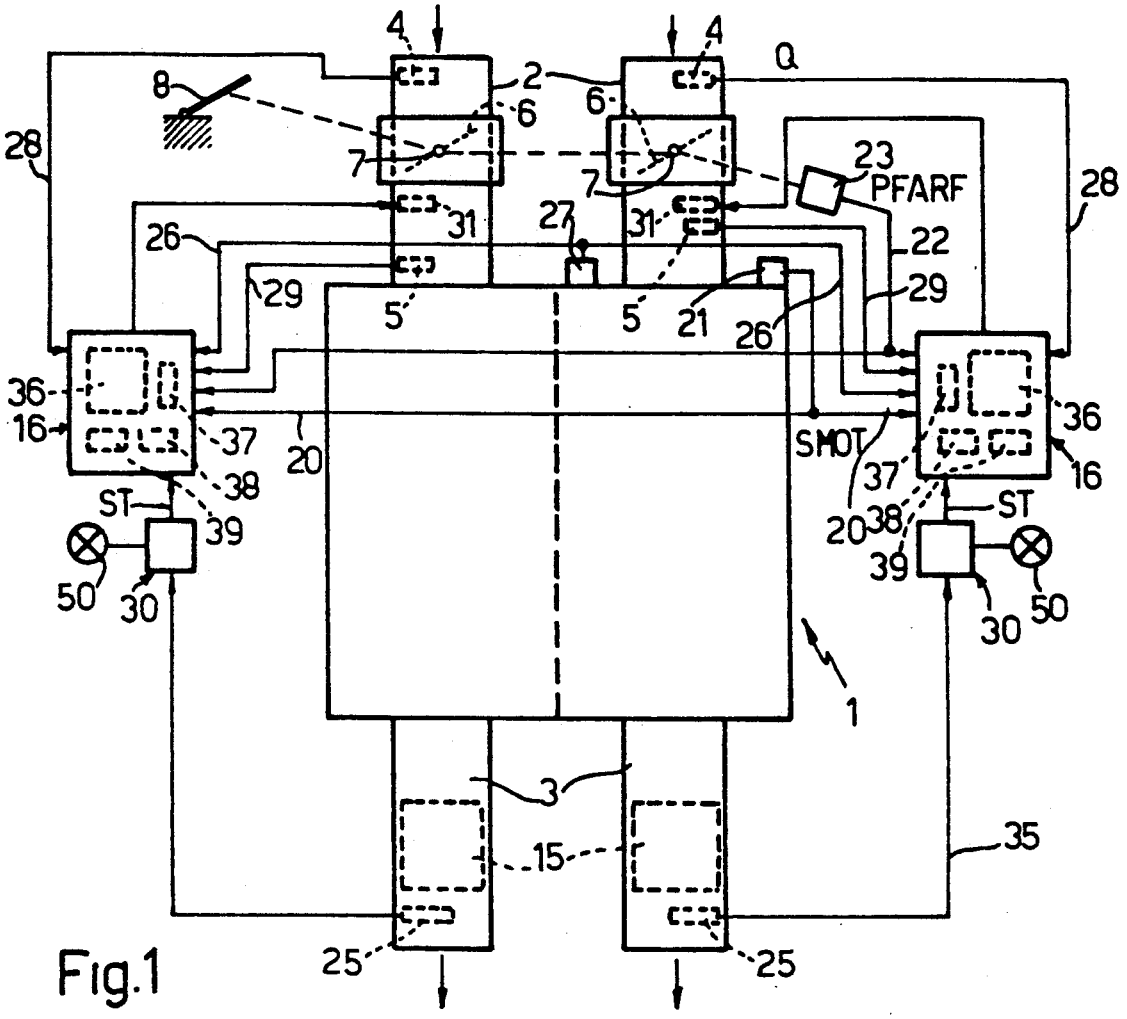
Fig.1
Fig.2
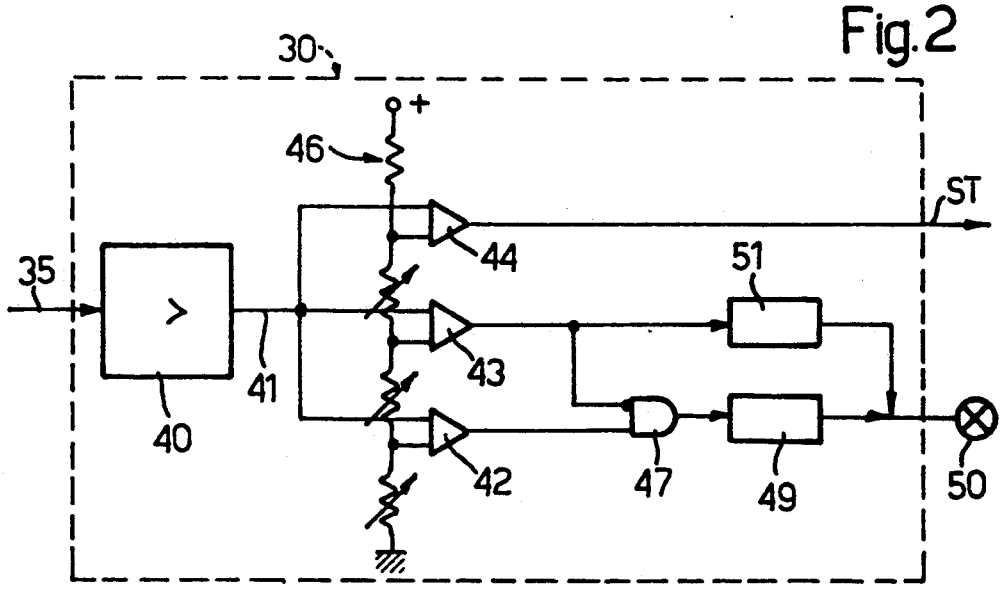

SYSTEM FOR PROTECTION OF AUTOMOTIVE EXHAUST GAS COMBUSTION DEVICES

BACKGROUND OF THE INVENTION

The present invention relates to a system for protecting automotive exhaust gas combustion devices, and is conveniently, though not exclusively, applicable to engines with two sets of cylinders, each featuring an electronic fuel injection system. The system according to the present invention is of the type comprising an electronic control system whereby a central processing unit receives information signals from sensor means for detecting major operating parameters, such as engine speed, the engine air intake throttle setting and actual air intake by the engine, and whereby said control system controls fuel injection by means of specific injectors for each cylinder.

Known exhaust gas combustion devices are located inside the exhaust pipe, and comprise catalyzing elements for oxidizing substantially all the major unburnt pollutant gases. Said oxidizing process involves the production of heat, the amount of heat produced by the combustion devices being proportional to the amount of unburnt gases involved, which in turn depends on the operating, and particularly the ignition, characteristics of the engine. In the event of malfunctioning of the engine, particularly due to non-ignition of the fuel mixture, the temperature of the catalyzing elements may easily reach as high as 1000° C., resulting in serious damage and, in view of the high cost of the elements themselves, considerable replacement costs.

Known warning devices for informing the driver of temperatures nearing said critical range fail to provide for effectively protecting the catalyzing elements, due to drivers often failing to adopt appropriate emergency measures.

SUMMARY OF THE INVENTION

The aim of the present invention is to provide a system for protecting automotive exhaust gas combustion devices, which is both highly reliable, regardless of the reaction of the driver, and relatively straightforward to produce.

With this aim in view, according to the present invention, there is provided a system for the protection of automotive engine exhaust gas combustion devices, said system comprising first sensor means for supplying a first signal as a function of the temperature of said combustion device; characterized by the fact that it comprises second means for supplying a second signal in response to said first signal reaching a threshold value indicating a predetermined maximum temperature of said combustion device; and third means for cutting off fuel supply to said engine in response to said second signal.

BRIEF DESCRIPTION OF THE DRAWINGS

A non-limiting embodiment of the present invention will be described by way of example with reference to the accompanying drawings, in which:

FIG. 1 shows a schematic diagram of the system according to the present invention, applied to an internal combustion engine featuring two sets of cylinders and two electronic fuel injection systems;

FIG. 2 shows a more detailed diagram of a block of the system shown in FIG. 1;

DETAILED DESCRIPTION OF THE INVENTION

Figure 3:
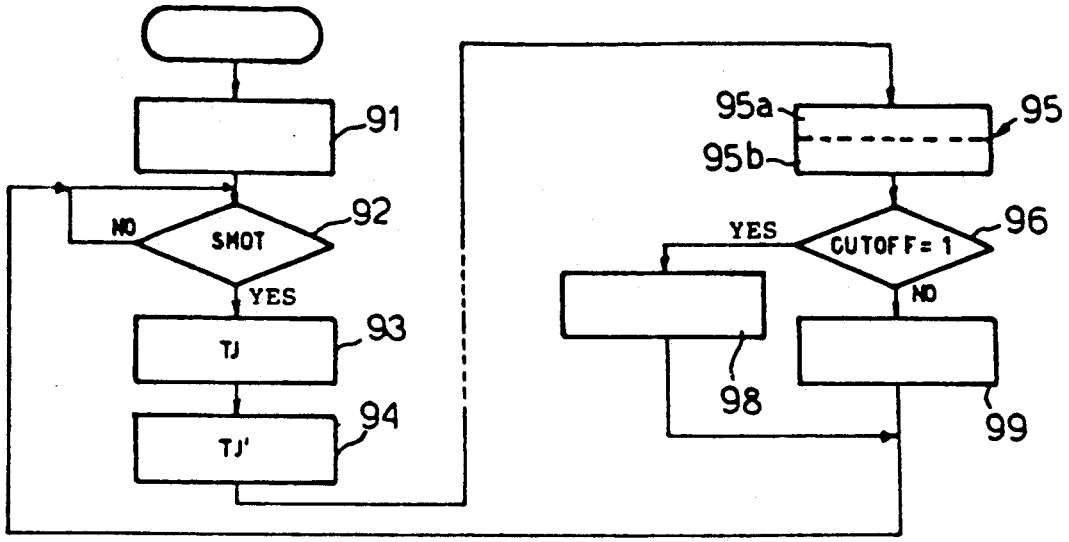
FIG. 3 is a flourhart showing the operation of the central processing unit of the electronic control system on the FIG. 1 system.

Number 1 in FIG. 1 indicates, schematically, an automotive internal combustion engine featuring two sets of cylinders, each having an intake pipe 2 and an exhaust pipe 3. Each intake pipe 2 houses in substantially known manner a main throttle valve 6 designed to turn about a shaft 7; an air intake sensor 4; and an air temperature sensor 5. The settings of throttle valves 6 in intake pipes 2 are controlled mechanically by an accelerator pedal 8.

Number 16 indicates an electronic control system for controlling the injection system of each set of cylinders on engine 1, said control system comprising a microprocessor-based central processing unit 36 (CPU) to which are connected a ROM block 37 for memorizing the basic injection times (TJ) on an injection map (Q-N) defining the operating area of engine 1 as a function of engine speed and air intake, and two counters 38 (CNT1) and 39 (CNT2).

Control system 16 receives:

- a first signal 20 (SMOT) from a sensor 21 for detecting the speed (N) of engine 1;
- a second signal 22 (PFARF) indicating the setting of throttle valve 6 and supplied by a potentiometer 23 connected in known manner to one of shafts 7;
- a third signal 26 from a sensor 27 for detecting the cooling water temperature of engine 1;
- a fourth signal 28 from air intake sensor 4; and
- a fifth signal 29 from intake air temperature sensor 5.

According to the present invention, control system 16 also receives a signal ST from a block 30 connected to a temperature sensor 25 housed inside each exhaust pipe 3, immediately downstream from a catalytic exhaust gas combustion device 15.

Control system 16 in turn supplies control signals for respective injectors 31 for each set of cylinders on engine 1. Though not shown for the sake of simplicity, control system 16 also conveniently provides for controlling the ignition of engine 1.

FIG. 2 shows a more detailed diagram of block 30, which receives a signal 35 from sensor 25 and supplies it to a level amplifying block 40, the output signal 41 of which is supplied to the respective inputs of three threshold comparators 42, 43, 44. The other inputs of said comparators 42, 43, 44 are connected to nodes of respectively increasing potential, defined by a calibratable resistive divider 46 connected between the positive supply and ground. The output of said first comparator 42 is connected to the input of an AND circuit 47, the other input of which receives, at inverted logic level, the output of said second comparator 43. The output of AND circuit 47 is connected to the input of an oscillating block 49 for flashing an indicator light 50 on the vehicle dashpanel. The output of said second comparator 43 is also connected directly to a block 51 for controlling steady operation of light 50. The output of said third comparator 44 supplies signal ST sent to control system 16.

The signal reception and transmission program of central processing unit 36 is a conventional type, which is repeated at convenient intervals of a few milliseconds. In particular (FIG. 3), start block 91, which provides for initiating the system, goes on to block 92, which determines whether a signal 20 (SMOT) has been received by central processing unit 36: a negative response goes back to the input of block 92, whereas, in the event of a positive response (i.e. at each engine phase), block 92 goes on to block 93, which calculates, in known manner via interpolation of a map stored in ROM memory 37, a basic injection time TJ as a function of parameters Q and N (air intake and the speed of engine 1) indicated by signals 28 and 20.

Block 93 then goes on to block 94, which provides in substantially known manner for correcting basic injection time TJ as required, to give a corrected value TJ'. The conditions determining such correction are detected via the signals from sensors 21, 27, 23, 5 and 4 taken both singly and jointly, and are due, for example, to temporary variations in operating parameters such as engine cooling water and intake air temperature; to specific operating conditions such as start-up of engine 1; or to transient operating states resulting from a sharp change in the setting of throttle valve 6. Block 94, possibly via further known correction and/or additional blocks (not shown), goes on to block 95 comprising two blocks 95*a* and 95*b*. According to the present invention, as a function of signal ST from block 30 (FIGS. 1 and 2) as described in more detail later on, block 95*a* provides for imposing a cut-off condition, i.e. for cutting off fuel supply to injectors 31, for safeguarding catalytic exhaust gas combustion device 15 against overheating; whereas block 95*b* determines in substantially known manner whether engine 1 is in a condition to implement the conventional cut-off strategy, i.e. by releasing accelerator pedal 8 with engine 1 running at a speed over and above a given threshold. Block 95 then goes on to block 96, which determines whether the CUTOFF indicator imposed by block 95 equals 1 (fuel supply to be cut off). In the event of a positive response, block 96 goes on to block 98, which disables injectors 31 and then goes back to block 92. In the event of a negative response in block 96, this goes on to block 99 which, as a function of the final injection time, prepares injectors 31 to operate, conveniently at the required phase, and then goes back to block 92.

The system according to the present invention therefore provides for safeguarding catalytic exhaust gas combustion devices 15 as follows. When, as a result of malfunctioning of even only one of the cylinder sets on engine 1, the temperature of the exhaust gases at the output of device 15 increases, this is detected by temperature sensor 25. When said temperature reaches a first threshold, e.g. 900° C., this activates comparator 42 which, via block 49, flashes indicator light 50 relative to the set of cylinders in question, to inform and induce the driver to slow down. Upon the temperature of the exhaust gases reaching a second threshold, e.g. 940° C., this activates comparator 43 which, via circuit 47, disables block 49 for directly controlling block 51 and turning on indicator light 50. Upon the temperature of the exhaust gases reaching a third threshold, e.g. 1000° C., this activates comparator 44, which supplies signal ST to control system 16, which in turn provides for cutting off fuel supply to injectors 31 of the cylinder set in question. The vehicle may thus continue running at reduced power, while at the same time protecting catalytic combustion devices 15 against overheating. As described in more detail later on, control system 16 may conveniently determine whether to cut off fuel supply immediately or after a given length of time, and also establish how long the fuel is to be cut off and the conditions whereby it is restored.

Figure 4:
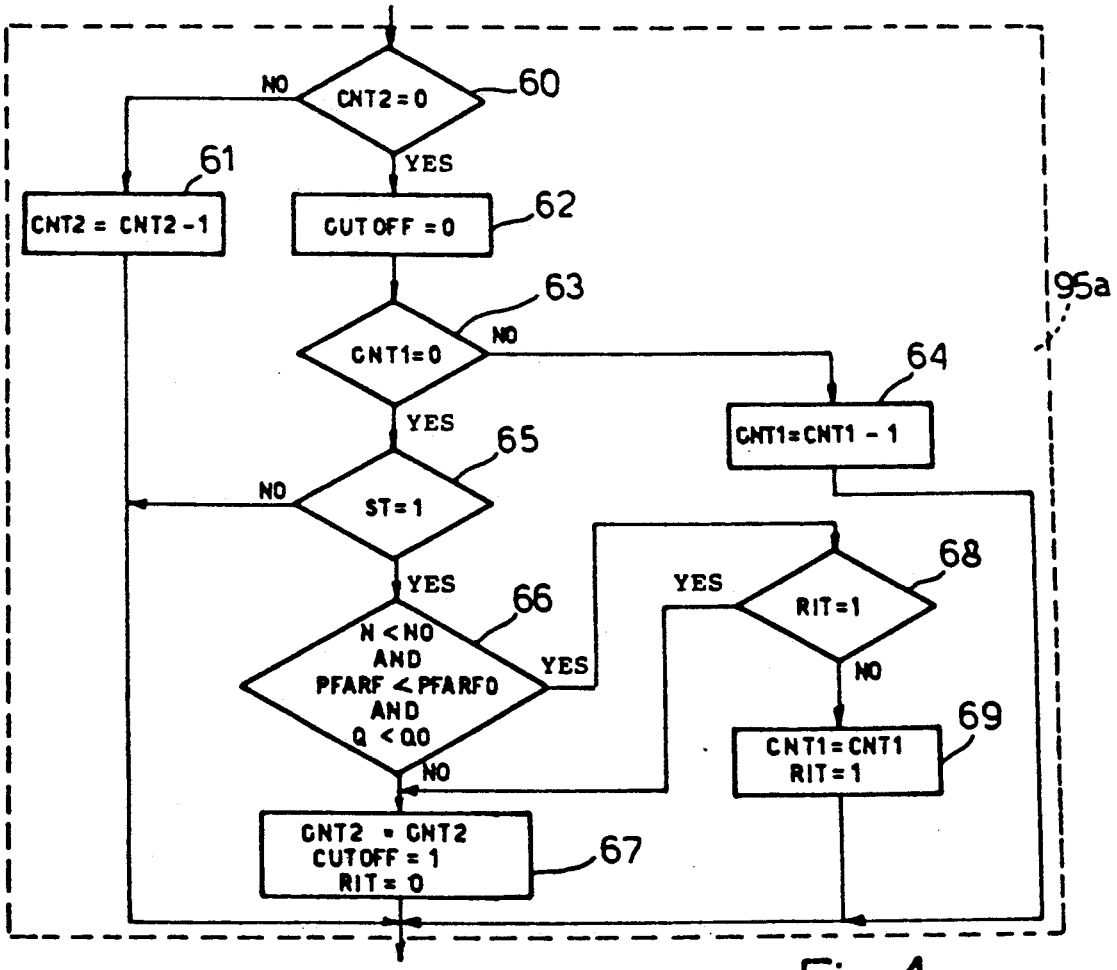
FIG. 4 shows a more detailed operating block diagram of a block shown in FIG. 3.

FIG. 4 shows a more detailed diagram of block 95*a* wherein a first block 60 determines whether the CNT2 value of counter 39 (controlling cut-off duration) equals 0. In the event of a negative response, block 60 goes on to block 61, which subtracts a one from the value of counter 39 and then exits block 95*a*. In the event of a positive response in block 60 (indicating fuel supply is enabled, e.g. due to termination of the previous cut-off period), block 60 goes on to block 62 which enters CUTOFF=0. Block 62 then goes on to block 63, which determines whether the CNT1 value of counter 38 (controlling the length of the fuel supply cut-off delay) equals 0. In the event of a negative response, block 63 goes on to block 64, which subtracts a one from the value of counter 38 and then exits block 95*a*. In the event of a positive response in block 63 (indicating fuel cut-off is enabled), block 63 goes on to block 65 which determines the logic value of the ST signal. If ST=0 (indicating that the temperature of the exhaust gases is below said third threshold relative to comparator 44), fuel supply need not be cut off, in which case, block 65 exits block 95*a*. If, on the other hand, ST=1, block 65 goes on to block 66, which determines whether the speed N of engine 1 is below a value NO; whether the opening of throttle valve 6 (indicated by signal 22 PFARF) is below a limit value PFARFO; and whether air intake (indicated by signal 28 Q) is below a limit value QO. In the event of a negative response (relatively high fuel supply), block 66 goes on to block 67, which provides for immediately cutting off fuel supply by entering CUTOFF=1; by entering CNT2 for counter 39 controlling the cut-off duration; and by entering RIT=0 (which resets the cut-off delay condition). Block 67 then exits block 95*a*. In the event of a positive response in block 66 (relatively low fuel supply), block 66 goes on to block 68, which determines whether RIT=1. In the event of a negative response (first detection of the block 66 condition), block 68 goes on to block 69, which imposes a fuel supply cut-off delay by entering a value CNT1 for counter 38 controlling the delay duration; and by entering RIT=1 (for establishing the cut-off delay condition). Block 69 then exits block 95*a*. In the event of a positive response in block 68 (delay time runout), block 68 goes on to block 67, which provides for immediately cutting off fuel supply.

The advantages of the present invention will be clear from the foregoing description. By means of a relatively straightforward design, conveniently employing a number of existing components on the vehicle, it provides for a low-cost, highly reliable system of protection which, even in the event of the driver disregarding warning light 50, provides for cutting off the fuel supply, thus preventing damage to the catalytic exhaust gas combustion devices, while at the same time enabling the vehicle to be driven at reduced power to the nearest service station.

To those skilled in the art it will be clear that changes may be made to the system as described and illustrated herein without, however, departing from the scope of the present invention. For example, changes may be made to the control program of central processing unit 36, and to the conditions governing cutoff and restoration of fuel supply. Moreover, restoration of fuel supply may be subject to further conditions, such as attainment of a minimum temperature threshold detected by sensor 15 and, like signal ST, supplied to control system 16. The system according to the present invention may also be applied to engines featuring only one set of cylinders and controlled by a single electronic control system (in which case, the vehicle would be stopped), as well as to engines with no electronic injection systems (in which case, the ST signal from block 30 would control the fuel supply pump). Moreover, exhaust gas temperature sensor 25 may be located differently, or the signal supplied to block 30 may be proportional, not to an absolute temperature detected by a single sensor 25, but to the temperature difference up- and downstream from devices 15 and detected by a pair of sensors. Finally, in addition to controlling light 50, blocks 49 and 51 may also control a sound alarm.

I claim:

1. A system for the protection of automotive engine exhaust gas combustion devices comprising means for supplying a first signal as a function of the temperature of said combustion device, means for supplying a second signal in response to said first signal reaching a threshold value indicating a predetermined maximum temperature of said combustion device, means for supplying a fourth signal in response to detection of predetermined engine operative conditions;

enabling means responsive to said second signal for outputting a third signal for cutting off said fuel supply in the presence of said fourth signal or enabling said time delay period in the absence of said fourth signal; and when said time delay period is enabled said enabling means outputting said third signal to said means for cutting off a fuel supply at the expiration of said delay time period of predetermined duration.

2. A system as claimed in claim 1, wherein said means for supplying a second signal comprise threshold comparing means for supplying said second signal.

3. A system as claimed in claim 1, wherein said means for supplying a second signal comprise threshold comparing means for supplying, as a function of said first signal, at least a fifth signal for activating an indicating device.

4. A system as claimed in claim 1, wherein said means for cutting off a fuel supply and said means for supplying a fourth signal comprise means for controlling the length of time said fuel supply is cut off.

5. A system as claimed in claim 1, wherein said means for cutting off a fuel supply and said means for supplying a fourth signal form part of an electronic fuel injection control system.

6. A system as claimed in claim 1, wherein said means for supplying a fourth signal comprise means for detecting the speed of said engine, means for detecting the air intake by said engine and means for detecting the setting of a main throttle valve in the intake pipe of said engine.

7. A system as claimed in claim 1, wherein said means for supplying a first signal comprise a single temperature sensor housed in an exhaust pipe downstream from said catalytic combustion device.

8. A system as claimed in claim 1, wherein said engine comprises at least two sets of cylinders, said, means for supplying a first signal, said means for supplying a second signal and said means for cutting off a fuel supply being operatively coupled to each set.

9. A system as claimed in claim 3, wherein said means for supplying a second signal outputs said fifth signal at a temperature of said combustion device which is lower than said predetermined maximum temperature.

* * * * *